US007139515B2

(12) United States Patent
Yamamoto et al.

(10) Patent No.: US 7,139,515 B2
(45) Date of Patent: Nov. 21, 2006

(54) ELECTROPHOTOGRAPHIC DEVICE AND CARRIER LIQUID REMOVAL MECHANISM

(75) Inventors: Noriko Yamamoto, Yokohama (JP); Hideki Nukada, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 120 days.

(21) Appl. No.: 10/951,639

(22) Filed: Sep. 29, 2004

(65) Prior Publication Data

US 2005/0220495 A1 Oct. 6, 2005

(30) Foreign Application Priority Data

Mar. 31, 2004 (JP) ..... 2004-103846

(51) Int. Cl.
*G03G 15/10* (2006.01)
*G03G 15/11* (2006.01)

(52) U.S. Cl. ..... 399/251; 399/92; 399/237; 399/249

(58) Field of Classification Search ..... 399/251, 399/249, 237, 57, 92, 348
See application file for complete search history.

(56) References Cited

U.S. PATENT DOCUMENTS 4,870,462 A * 9/1989 Day ..... 399/249
6,650,857 B1 11/2003 Nukada et al.
6,920,823 B1 * 7/2005 Nukada et al. ..... 101/175
2002/0028090 A1 * 3/2002 Shin et al. ..... 399/251
2002/0131794 A1 * 9/2002 Nukada et al. ..... 399/249
2004/0234298 A1 * 11/2004 Nukada et al. ..... 399/251

FOREIGN PATENT DOCUMENTS

JP 5-224539 9/1993
JP 2001-083806 A * 3/2001
JP 2002-278302 A * 9/2002

OTHER PUBLICATIONS

U.S. Appl. No. 10/792,835, filed Mar. 5, 2004, Nukada et al.

* cited by examiner

*Primary Examiner*—Sophia S. Chen
(74) *Attorney, Agent, or Firm*—Oblon, Spivak, McClelland, Maier & Neustadt, P.C.

(57) ABSTRACT

To remove a carrier liquid from a toner image before transfer on a photosensitive drum, a wet electrophotographic device of the present invention includes a first slit nozzle which blows airflow of a first velocity onto a surface of the photosensitive drum after image formation, a second slit nozzle which is positioned on a downstream side more than the first slit nozzle and which blows airflow of a second velocity higher than that of the airflow supplied from the first slit nozzle onto the surface of the photosensitive drum, and an aperture portion which introduces a reverse airflow generated by the airflow from the second slit nozzle to the first slit nozzle side between both nozzles.

9 Claims, 3 Drawing Sheets

ELECTROPHOTOGRAPHIC DEVICE AND CARRIER LIQUID REMOVAL MECHANISM

CROSS-REFERENCE TO RELATED APPLICATIONS

This application is based upon and claims the benefit of priority from prior Japanese Patent Application No. 2004-103846, filed Mar. 31, 2004, the entire contents of which are incorporated herein by reference.

BACKGROUND OF THE INVENTION

1. Field of the Invention

The present invention relates to an electrophotographic device which uses liquid toner, and more particularly to a carrier liquid removal mechanism which removes a carrier liquid from an image before transfer.

2. Description of the Related Art

A wet electrophotographic device that uses liquid toner has advantages not achieved by a dry electrophotographic device that uses powder toner, and greater importance has recently been attached to its value.

For example, since extremely small toner of a submicron size can be used, image quality is high, and a texture similar to that of printing (e.g., offset printing) can be realized. Since a sufficient image density can be obtained by a small amount of toner, the toner can be fixed on a sheet economically at a relatively low temperature. As a result, energy is saved.

In the case of the wet electrophotographic device, a toner image formed on a photosensitive body, and the residual carrier liquid left near the toner image must be removed. As one of the methods of removing carrier liquid, for example, Jpn. Pat. Appln. KOKAI Publication No. 2002-278302 discloses a method of removing the residual carrier liquid by blowing airflow along the surface of a photosensitive body, wherein there are two or more nozzles for blowing air.

However, a velocity of airflow that passes through a narrow gap area along the surroundings of the photosensitive body causes airflow reflection or interference. The airflow reflection or interference moves a toner image (image) on the photosensitive body (generates image run) at an initial stage in which a large amount of the residual carrier liquid remains after image formation. Consequently, deterioration of image quality is inevitable.

BRIEF SUMMARY OF THE INVENTION

An object of the present invention is to remove a carrier liquid without causing toner movement (image run) of a toner image (on image before transfer) formed on a photosensitive body in a wet electrophotographic device which forms a toner image from liquid toner, and transfers the toner image to an output medium to obtain a printed output.

According to an aspect of the invention, there is provided an image forming device comprising: an image forming device comprising: a photosensitive member, having an outer peripheral surface and rotating in a rotational direction, which holds an electrostatic latent image, on the outer peripheral surface; a developing device which supplies a liquid developer containing toner particles and a carrier liquid to the electrostatic latent image to form a developer image on the outer peripheral surface of the photosensitive member; and a cover wall, located downstream side of the developing device with respect to the rotational direction of the photosensitive member and extended along the outer peripheral surface of the photosensitive member with a gap relative to the outer peripheral surface of the photosensitive member, which guide an airflow, the cover wall includes an airflow supplying portion which makes airflow of a predetermined velocity in a direction directed to the downstream-side of the rotational direction of the photosensitive member in which the outer peripheral surface of the photosensitive member is moved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Next, the preferred embodiment of the present invention will be described with reference to the accompanying drawings.

Figure 1:
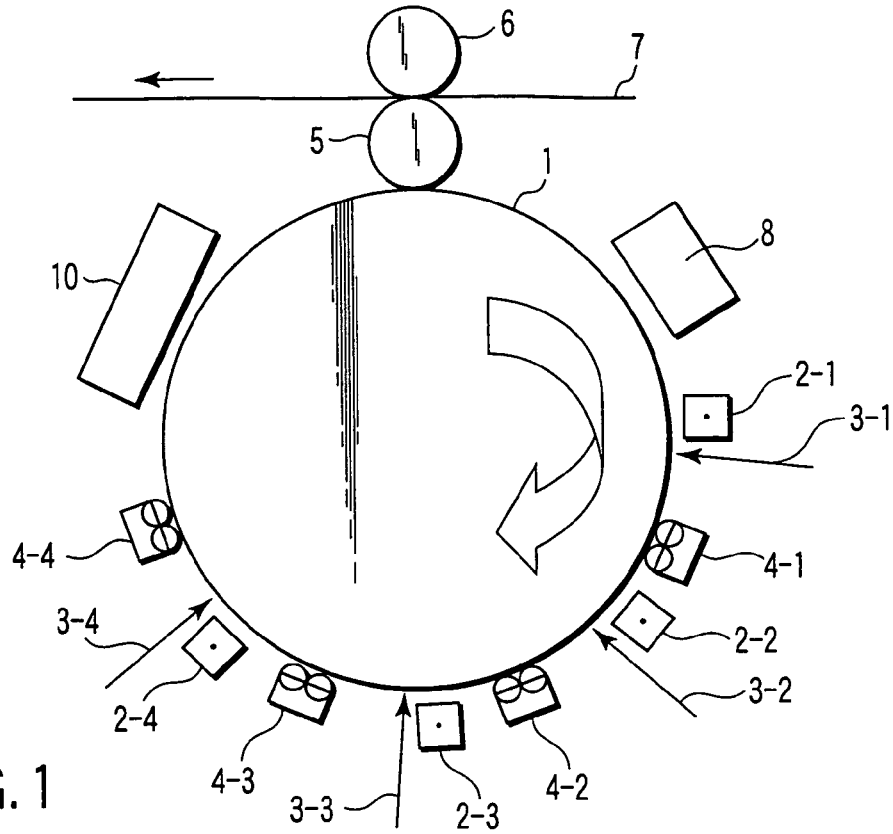
FIG. 1 is a schematic diagram showing an example of an image forming section of a wet electrophotographic device according to an embodiment of the invention.

FIG. 1 shows an example of an image forming section of a wet electrophotographic device of the invention.

As shown in FIG. 1, a photosensitive member (an image carrier) 1 is a photosensitive drum in which an organic or amorphous silicon photosensitive layer is disposed on a conductive substrate.

The photosensitive drum 1 is uniformly charged by a well-known corona charger or a scorotron charger 2-1, and then an electrostatic latent image is formed on a surface by an expose 3-1, for example, a laser beam modulated by image information or a light emitted from an image pixel of an array-like LED turned ON/OFF in accordance with image data.

The electrostatic latent image formed on the photosensitive drum 1 is developed to be visible by a developing device 4-1 which contains a carrier liquid as an insulating liquid of no polarity, and liquid toner having toner particles as mixtures of resins and coloring materials dispersed in the carrier liquid.

Subsequently, the photosensitive drum 1 is charged again to a predetermined potential by a second charger 2-2, and an electrostatic latent image is formed by a second expose 3-2.

The second electrostatic latent image is developed by a second developing device 4-2 which contains liquid toner including second toner of a color different from that of the liquid toner contained in the first developing device 4-1.

Thereafter, a third electrostatic latent image is formed by a third charger 2-3 and a third expose 3-3, and developed by a third developing device 4-3. Further, a fourth electrostatic latent image is formed by a fourth charger 2-4 and a fourth expose 3-4, and developed by a fourth developing device 4-4.

Thus, a toner image of a 4-color stacked state (full color) is formed on the photosensitive layer of the photosensitive drum 1.

The 4-color stacked toner image is transferred from the photosensitive drum 1 to an intermediate transfer body 5, and transferred to a sheet 7 supplied between the intermediate transfer body 5 and a pressure roller 6. The toner image transferred to the sheet 7 by the intermediate transfer body 5 is not limited to the 4-color image. Needless to say, it may be an optional 1-color image or a combination of a predetermined number of colors.

The residual toner stay on the photosensitive drum 1 is removed by a cleaner 8 disposed between the first charger 2-1 and the intermediate transfer body 5.

Transfer of the toner image between the intermediate transfer body 5 and the photosensitive drum 1 is carried by, e.g., a pressure transfer system which brings both into contact with each other by predetermined contact pressure, i.e., the toner image on the photosensitive drum 1 is transferred to the intermediate transfer body 5 by pressure transfer.

In the pressure transfer system, the residual carrier liquid left in a developed image must be removed enough to transfer to the intermediate transfer body 5. The carrier liquid remains among the toner particles constituting a toner image, or between the toner and the photosensitive drum 1. In other words, when the surface of the photosensitive drum 1 is wet (in a nondry state), the high transfer efficiency is not available, in more often. Accordingly, to surely realize pressure transfer, it is essential to remove the residual carrier liquid from the developed image before transfer up to a state in which a dry state is substantially set.

Thus, preferably, drying is carried out until the amount of the residual carrier liquid becomes a predetermined amount, so called a dry state, while the developed image is conveyed to a transfer position in which the intermediate transfer body and the photosensitive body are brought into contact with each other. For this purpose, in the image forming section of an image forming device shown in FIG. 1, a drying unit 10 is disposed between a developing section (rearmost developing device when a plurality are disposed) and the intermediate transfer body 5.

The drying unit 10 is a blower unit which blows airflow of a predetermined velocity to the surface of the photosensitive drum 1. The drying unit 10 removes the carrier liquid by generating an airflow along the surface of the photosensitive drum 1. The velocity of the airflow flowing along the surface of the photosensitive drum 1 is set to, e.g., about 50 to 120 m/sec.

Figure 2:
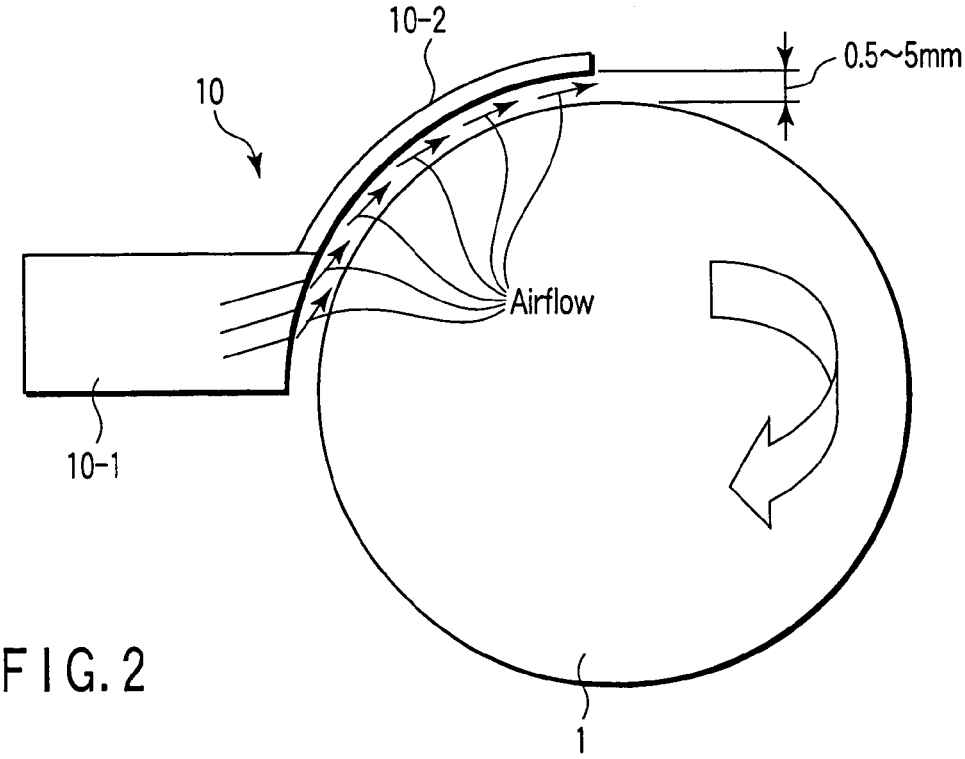
FIG. 2 is a schematic diagram showing an example of a drying unit used for the image forming section shown in FIG. 1.

FIG. 2 schematically shows the drying unit (blower unit) 10.

The drying unit, i.e., the blower unit 10, shown in FIG. 2 is disposed along the surface of the photosensitive drum 1, i.e., an outer peripheral surface (cylindrical surface) of the photosensitive drum 1, and functions as a cover wall to cover at least a part of the photosensitive drum 1.

The blower unit 10 includes a nozzle (nozzle block) 10-1 and a cover wall, i.e., a hood 10-2, and provides airflow to a gap between the photosensitive drum 1 and the hood 10-2. The airflow supplied from the nozzle 10-1 flows along the surface of the photosensitive drum 1 at a predetermined velocity, whereby the carrier liquid is substantially removed from the surface of the photosensitive drum 1 and from the toner particles (toner image is substantially dried).

For the toner image formed on the photosensitive drum 1, mutual electrostatic cohesion of toner particles is increased on a downstream side of a dry area in which the blower unit 10 and the photosensitive drum 1 are opposed to each other before the airflow is sprayed. To increase the mutual electrostatic cohesion of the toner particles, for example, a set charger is disposed (not shown). The set charger applies a predetermined electric field to the photosensitive drum 1 and the toner image to increase the mutual electrostatic cohesion of the toner particles (and/or electrostatic cohesion between the photosensitive drum 1 and each toner particle), i.e., formation strength (image strength).

The nozzle (nozzle block) 10-1 includes, e.g., two or more nozzles, and can supply the airflow of the predetermined velocity along the surface of the photosensitive drum 1 and from an upstream side to a downstream side while the rotational direction of the photosensitive drum 1 is a starting point.

The nozzle (nozzle block) 10-1 has an opening extended in a width direction, i.e., an axial direction, of the photosensitive drum 1 so that the airflow can spread to the entire area in which the surface of the photosensitive drum 1 is dried, and arranged close to the photosensitive drum 1 through a predetermined gap with the surface thereof.

Figure 3:
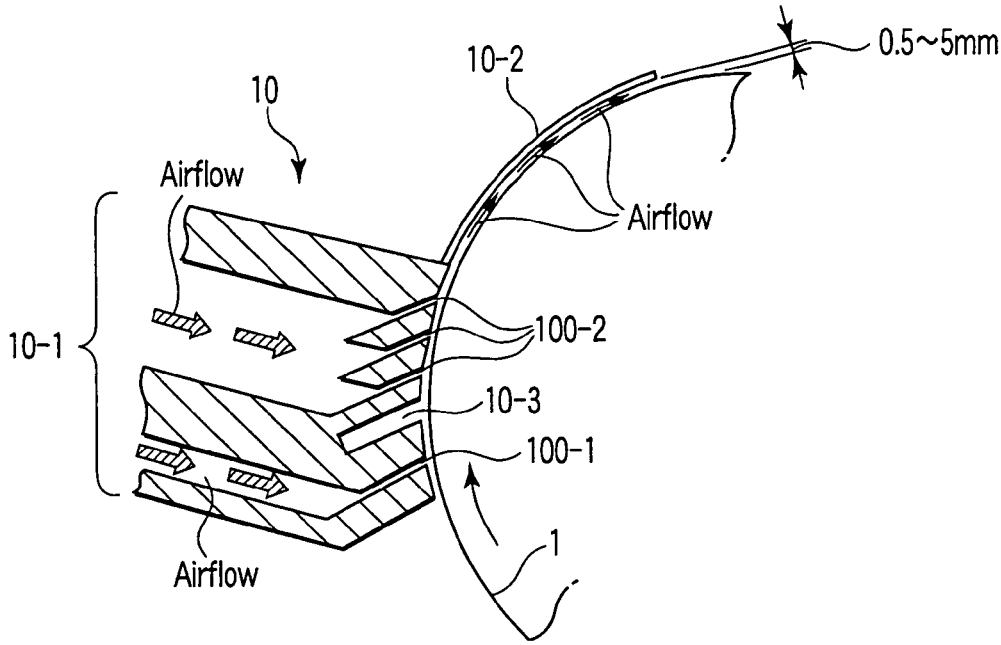
FIG. 3 is a schematic diagram showing an embodiment of the drying unit shown in FIG. 2.

More specifically, as shown in FIG. 3, the nozzle block of the invention is opposed to the photosensitive drum 1 while a gap between it and the surface of the photosensitive drum 1 is about 0.5 to 5 mm.

Incidentally, the velocity of the airflow in the gap is higher as the gap is narrower. For example, when airflow is blown at a velocity higher than 120 m/sec., image flowing in which the toner image moves on the photosensitive drum 1 occurs. Additionally, since a tip of the nozzle may disadvantageously come into contact with the photosensitive drum 1 due to nozzle shape accuracy, mounting accuracy or the like, a minimum value of the gap is preferably about 0.5 mm.

As shown in FIG. 3, the nozzle block 10-1 includes a first nozzle (slit nozzle) 100-1, and a second nozzle (slit nozzle) 100-2 disposed at a predetermined interval from the first slit nozzle 100-1. The second slit nozzle 100-2 is disposed on the downstream side of the rotational direction of the photosensitive drum 1 more than the first slit nozzle 100-1.

The first slit nozzle 100-1 is further divided into at least two slit nozzles. The first slit nozzle 100-1 is connected to the hood 10-2 on the downstream side of the rotational direction of the photosensitive drum 1. Since the downstream side of the nozzle (nozzle block) 10-1 is covered with the hood-like member 10-2, diffusion of the airflow is prevented to increase drying efficiency.

Between the downstream side (second) slit nozzle 100-2 and the upstream side (first) slit nozzle 100-1, an opening 10-3 is disposed.

The slit nozzles 100-1, 100-2, and the hood 10-2 are formed with predetermined lengths in the width direction (axial direction) of the photosensitive drum 1.

The hood 10-2 is formed along a curve of the surface of the photosensitive drum 1 to maintain effects of the airflow immediately before the transfer position in which the intermediate transfer body 5 and the photosensitive drum 1 are brought into contact with each other.

At least the two nozzles of the upstream side first slit nozzle 100-1 are useful for blocking movement (image traveling) of the toner image, i.e., the toner particles or the carrier liquid, on the photosensitive drum 1 by airflow blowing.

The first and second slit nozzles 100-1, 100-2 are connected to a blowing mechanism (blower, not shown), and airflow of a predetermined velocity, i.e., air, is supplied thereto. The slit nozzles 100-1, 100-2 are arranged to supply airflow directed to the downstream side of the rotational direction of the photosensitive drum 1 to prevent flowing of airflow into the first to fourth developing devices 4-1, 4-2, 4-3, and 4-4. If the airflow flows into the developing device, toner liquid, i.e., liquid developer, is scattered. Thus, an angle between a chief flow (equivalent to nozzle center line) of the airflow blown from the nozzle and a tangent of the photosensitive drum 1 is preferably 30° to 75°, more preferably 45° to 60°.

In the nozzle block 10-1 shown in FIG. 3, a velocity of airflow blown from the second (downstream side) slit nozzle 100-2 to the surface of the photosensitive drum 1 is set smaller than that of airflow blown from the first (downstream side) slit nozzle 100-1 to the surface of the photosensitive drum 1. Such setting of the velocity of the airflow can prevent running of the toner particles of the toner image on the photosensitive drum 1 together with the carrier liquid by the airflow supplied from the second (upstream side) slit nozzle 100-2. For example, one of the conditions for running of toner particles together with the carrier liquid is a case in which the velocities of the airflow blown from the first and second nozzles to the surface of the photosensitive drum 1 are substantially equal to each other, and each velocity of the airflow is about 100 m/sec. As conditions for running of toner particles with the carrier liquid, to define a velocity of airflow, 80 m/sec. or lower is preferable.

That is, as one condition, a velocity of the airflow supplied from the second slit nozzle 100-2 positioned on the downstream side of the rotational direction of the photosensitive drum 1 to the same is set within a predetermined range to suppress the traveling of toner with the carrier liquid. By using the airflow from the second nozzle before the airflow of a velocity is higher than the second nozzle is supplied from the first nozzle, the carrier liquid can be removed to a certain extent while preventing the running of toner particles. In this state, the airflow is blown to the surface of the photosensitive drum 1. By this airflow supplying of the second stage, it is possible to prevent undesired movement of the toner image, i.e., the toner of the toner image (image traveling). Incidentally, the process of blowing the airflow of a velocity from the second slit nozzle 100-2 smaller than that of the airflow from the first slit nozzle 100-1 is referred to as "predrying" hereinafter.

As described above, when the toner image formed on the photosensitive drum 1 and the carrier liquid left in a peripheral area including the toner image are removed by the airflow blowing, the process of predrying is set. According to the predrying, a velocity of airflow blowing from the downstream side slit nozzle 100-2 to the photosensitive body is set lower than that of airflow blown from the upstream side slit nozzle 100-1 to the photosensitive drum 1. The predrying can block running (movement) of the toner particles of the toner image together with the carrier liquid. That is, preferably, by the predrying, the carrier liquid is set to a state of being easily evaporated without destroying the image (toner image), and then the carrier liquid is removed by a strong airflow of a predetermined velocity or a large flow rate.

A method of changing the velocity of airflow supplied from each of the slit nozzles 100-1, 100-2 to the photosensitive drum 1 can be easily achieved by independently disposing a blower. For example, the method can be achieved by setting a size of the opening of the downstream (second) slit nozzle 100-2 larger than that of the upstream (first) slit nozzle 100-1.

However, it has been verified that the airflow blown to the surface of the photosensitive drum 1 with the angle is reflected thereon, or repeatedly reflected in the gap between the nozzle block and the photosensitive drum 1 to reversely blow to the upstream side.

For example, when airflow of a velocity variance is blown to the surface of the photosensitive drum 1, a part of the airflow from the upstream side (first) slit nozzle 100-1 may overwhelm the airflow from the downstream side (second) slit nozzle 100-2.

In this case, the aforementioned predrying is not established. That is, the toner particles of the toner image are traveled, and/or the carrier liquid remains to reduce transfer efficiency, causing an image failure. Thus, the interference of the airflow for the predrying (airflow from the second slit nozzle 100-2 ) with the airflow for real drying of a rear stage (airflow from the first slit nozzle 100-1 ) must be suppressed as much as possible.

The problem can be solved by the opening 10-3 disposed between the downstream side slit nozzle 100-2 and the upstream side slit nozzle 100-1 for the following reasons.

Figure 4:
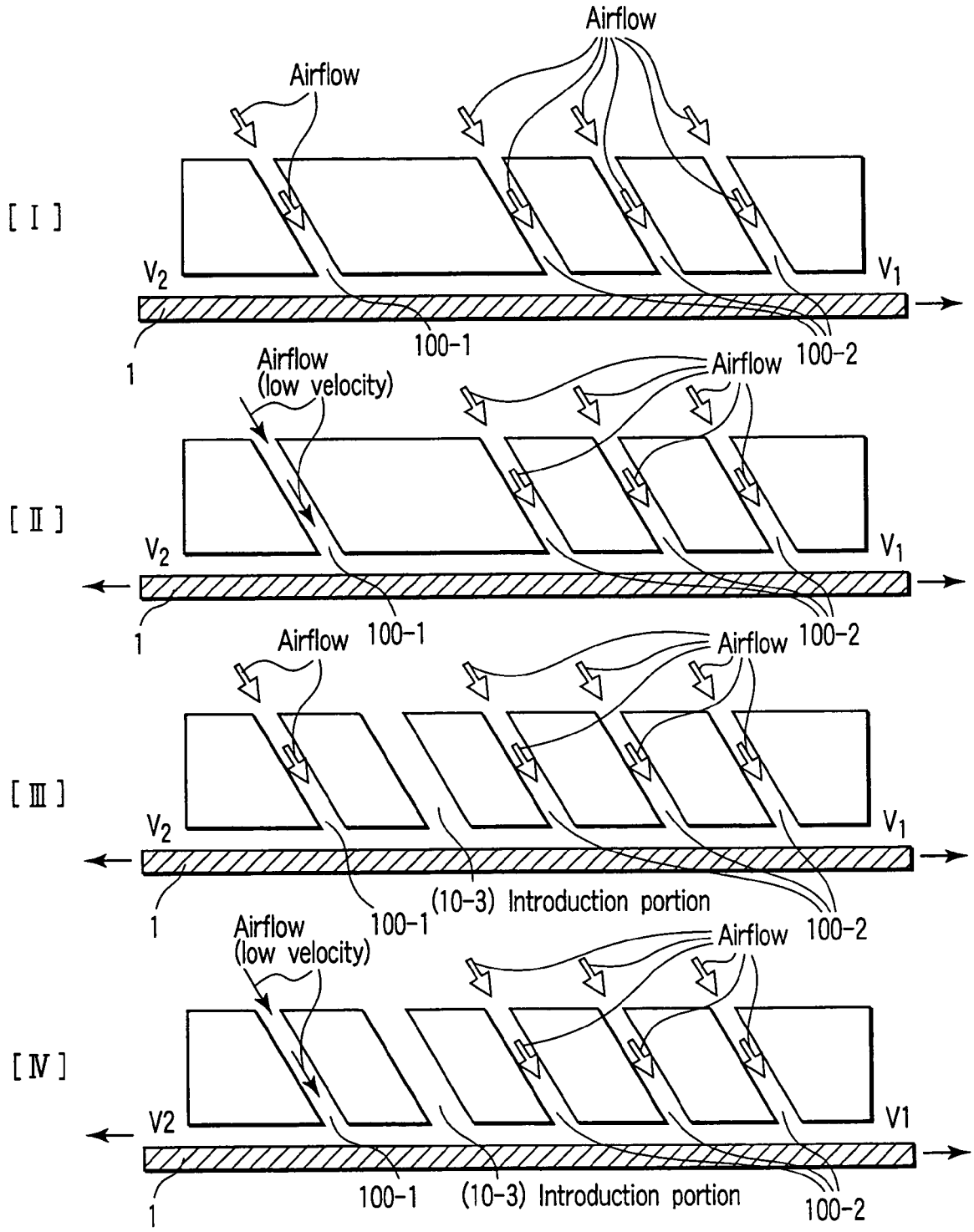
FIG. 4 is schematic diagram showing special effects obtained by the drying unit shown in FIG. 3.

FIG. 4 showing example of conditions (constitutions) of simulation carried out to clarify a degree of a reverse flow of the airflow from the upstream side slit nozzle 100-1 to the downstream side by the opening 10-3.

Part of [I] of FIG. 4 shows a case in which flow velocities of the airflow from the slit nozzles 100-1, 100-2 are equal to each other. Part of [II] of FIG. 4 shows a case in which a velocity of the airflow from the downstream side nozzle 100-2 is lower than that of the airflow from the upstream side nozzle 100-1. Part of [III] of FIG. 4 shows a case in which flow velocities of the airflow from the slit nozzles 100-1, 100-2 are equal to each other, and an opening (an airflow introduction portion) 10-3 is disposed. Part of [IV] of FIG. 4 shows a case in which an opening (the airflow introduction portion) 10-3 is disposed while a velocity of the airflow from the downstream side nozzle 100-2 is set lower than that of the airflow from the upstream side nozzle 100-1. Part of [III] of FIG. 4 shows a constitution in which the aperture portion (introduction portion) is added to the constitution of part of [I] of FIG. 4. part of [IV] of FIG. 4 shows a constitution in which the aperture portion (introduction portion) is added to the constitution of part of [III] of FIG. 4.

TABLE 1 shows a result of obtaining a ratio of V1 to V2 (V2/V1) % by simulation under W1 which is a velocity of airflow blown from the upstream side (first) nozzle, W2 which is a velocity of airflow blown from the downstream side (second) nozzle, W1=W2 or W1>W2 which is presence of a difference in a velocity between airflow from both nozzles, V1 which is a velocity of airflow flowing from the downstream side of the nozzle block along the photosensitive drum 1, and V2 which is a velocity of airflow flowing from the upstream side of the nozzle block along the photosensitive drum 1 in the constitutions (conditions) shown in FIG. 4. In the TABLE 1 (conditions [I] to [IV]), directions of V1 and V2 are opposed to each other (velocity of airflow is represented by setting a blowing direction as "forward", i.e., airflows from a rear end of an arrow to a tip). An angle between a chief flow (equivalent to nozzle center line) of airflow and a tangent of the photosensitive drum 1 is 45°. The tips of each of the nozzles is coordinated to the downstream side, there is the case where the velocity of the airflow for the upstream side is larger than the velocity of the airflow for the downstream side denoted by a reverse flow.

TABLE 1

| | Relation of airflow velocity size | Aperture | Simulation conditions W1 (downstream) | Simulation conditions W2 (upstream) | Simulation results (standardized by V1 of (a) = 100) V1 (downstream) | Simulation results V2 (upstream) | Velocity ratio V2/V1 (%) |
|---|---|---|---|---|---|---|---|
| [I] | W1 = W2 | Absent | 5 | 5 | 100 | 85 | 85 |
| [II] | W1 > W2 | Absent | 5 | 1 | 87 | 63 | 72 |
| [III] | W1 = W2 | Present | 5 | 5 | 72 | 26 | 36 |
| [IV] | W1 > W2 | Present | 5 | 1 | 71 | 20 | 28 |

Airflow velocity of air from downstream side nozzle 100-2: W1
Airflow velocity of air from upstream side nozzle 100-1: W2
Airflow velocity of air sprayed from downstream side of nozzle block: V1
Air flow velocity of air sprayed from upstream side of nozzle block: V2

From the TABLE 1, in the condition [I], a difference between the velocity of the airflow for the upstream side and the velocity of the airflow for the downstream is about 15% (the velocity difference ratio is 85%), i.e., there is a considerably large reverse flow. In the condition [II], it is recognized that the velocity of the airflow of the downstream side is reduced because the velocity of the airflow from the upstream side (second) slit nozzle is reduced. However, it is recognized that there is almost no change of a degree of the reverse flow from that of the condition [I].

On the other hand, in the condition [III], it can be understood that an influence (generation of reverse airflow and/or interference between airflows of two directions) given by the airflow from the upstream side (first) slit nozzle 100-1 to that from the downstream side (second) slit nozzle 100-2 is suppressed. In this case, the velocity of the airflow from the downstream side (first) slit nozzle 100-1 is reduced (weakened). This can be easily understood by presuming a reason to be that the airflow from the downstream side (second) nozzle 100-2 and the airflow from the upstream side (first) nozzle 100-1 are introduced into the opening 10-3.

Incidentally, it is recognized that as in the case of the condition [IV], by disposing the opening 10-3 between the downstream side nozzle 100-2 and the up stream side nozzle 100-1, and reducing the velocity of the airflow blown from the downstream side (second) nozzle 100-2 to the photosensitive drum 1, the velocity of the airflow of the upstream side can be suppressed airflow.

That is, it has been verified that as shown in the conditions [III] and [IV], by disposing the opening 10-3 between the downstream side nozzle 100-2 and the upstream side nozzle 100-1, a reverse airflow generated on the downstream side is introduced into the aperture portion, and no influence is given to the upstream side (interference between airflows of two directions is reduced). Here, considering flowing and/or its easiness of the reverse airflow to the aperture portion, preferably, an opening of the aperture portion is larger than the size of the opening of each of the slit nozzles 100-1, 100-2, and a size of the gap between the nozzles 100-1, 100-2 and the photosensitive drum 1.

In the constitution of carrying out the simulation in each of FIG. 4, the gap between the photosensitive drum and the nozzle block is simply linear. However, even when the photosensitive drum is actually cylindrical, a substantially similar tendency is obtained since-the airflow flows along a surface of the cylindrical drum.

For conformation, a drying unit 10 which comprised a nozzle block 10-1 having a nozzle of a slit similar in shape to that of the condition shown in part of [IV] of FIG. 4 arranged therein was manufactured, incorporated into the wet electrophotographic device shown in FIG. 1, and subjected to experiment.

As an example, the surface of the photosensitive drum 1 was charged to 750 V, and rotated in a predetermined direction (clockwise in FIG. 1) at 220 mm/sec. to form a latent image. When airflow was blown to a toner image (image) obtained by developing the latent image with a liquid developer, a good image of no movement (image run) of the toner image was obtained. The liquid developer was prepared by dispersing toner particles of an average particle diameter 0.8 μm in which a black pigment was added to an acrylic resin in a hydrocarbon carrier liquid (Isopar L: by Exxon Mobile Chemical Corporation).

For comparison, when the opening 10-3 was sealed by a resin sheet (adhesive tape) and airflow of a similar velocity was blown thereto, image run (movement of toner image) occurred.

Figure 5:
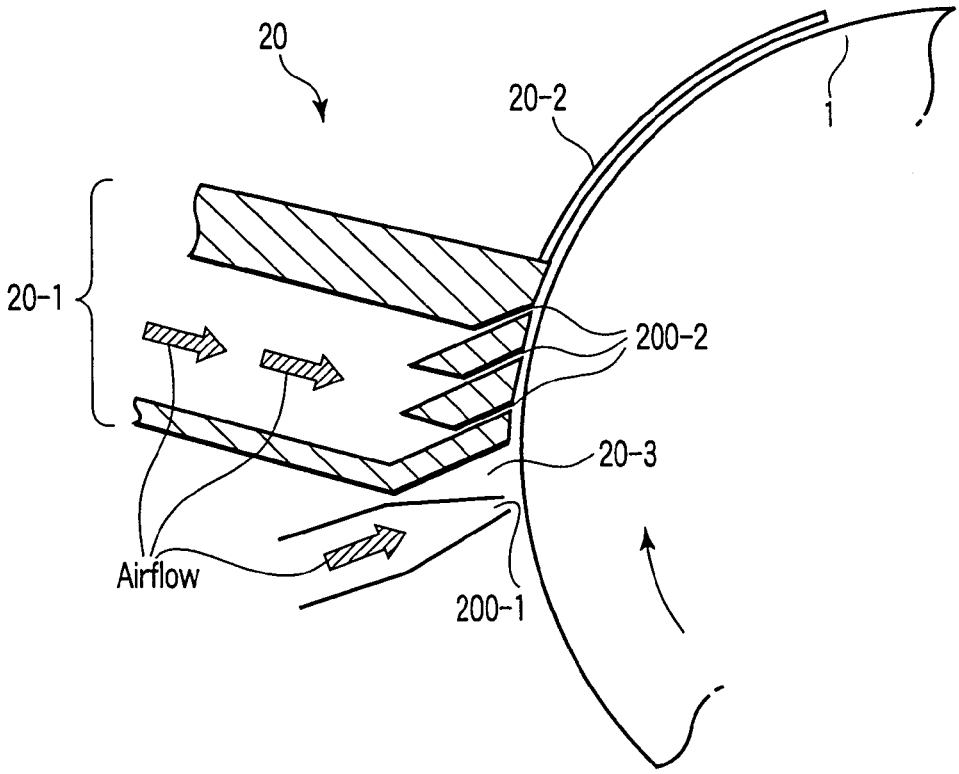
FIG. 5 is a schematic diagram showing another embodiment of the drying unit shown in FIG. 2.

FIG. 5 shows another embodiment. To differentiate it from the embodiment described above with reference to FIGS. 2 and 3, reference numerals to which "10 or 100" is added are used.

A drying unit 20 of FIG. 5 is constituted by independently disposing the first (upstream side) slit nozzle and the second (downstream side) slit nozzle of the nozzle block described above with reference to FIG. 3, and a structural aperture between the slit nozzles can be used as an aperture portion 20-3.

Specifically, the drying unit 20 comprises nozzle blocks 20-1 and 20-2. The nozzle block 20-1 includes a first (downstream side) slit nozzle 200-2 in which an airflow discharging direction, i.e., an airflow blowing direction, is directed to a hood 20-2 side. On an upstream side of a rotational direction of the photosensitive member 1 more than the first (downstream side) slit nozzle 200-2, a second (upstream side) slit nozzle 200-1 is disposed to be independent of the nozzle block 20-1. Between the nozzle block 20-1 and the first slit nozzle 200-1, a process of defining the aperture portion 20-3 (process of constituting the opening portion 20-3) is unnecessary.

Arraying of the nozzle block 20-1 and the second slit nozzle 200-2 shown in FIG. 5 is suitable to, e.g., a case in which each blower (not shown) is disposed since a velocity of airflow blown from each of the slit nozzles 200-1 (nozzle block side) and 200-2 (upstream side) to the photosensitive drum 1 is independently set.

As described above, according to the present invention, it is possible to prevent image traveling caused by movement of toner particles constituting an image due to airflow of a predetermined velocity for removing a carrier liquid from the image formed by using a liquid developer in which the toner particles are dispersed in the carrier liquid.

The present invention is not limited to the foregoing embodiments, but various modifications and changes can be made without departing from its teachings at the stage of implementation. The embodiments can be combined to be implemented as much as possible. In such a case, effects by the combination can be obtained.

Furthermore, the invention has been described by way of example of the transfer device which comprises the intermediate transfer body 5 and the pressure roller 6. However, the pressure roller 6 may be pressed into contact with the photosensitive drum 1 to directly transfer the image from the photosensitive drum 1 to the recording medium 7. Incidentally, by supplying a predetermined amount of electric charges to improve electrostatic cohesion of toner particles on the upstream side of the drying unit which removes the carrier liquid to dry the image, it is possible to further prevent the image from running.

What is claimed is:

1. An image forming device comprising:

a photosensitive member, having an outer peripheral surface configured to rotate in a rotational direction, said photosensitive member configured to hold an electrostatic latent image, on the outer peripheral surface;

a developing device configured to supply a liquid developer containing toner particles and a carrier liquid to the electrostatic latent image to form a developer image on the outer peripheral surface of the photosensitive member; and a cover wall, located downstream side of the developing device with respect to the rotational direction of the photosensitive member and extended along the outer peripheral surface of the photosensitive member with a gap relative to the outer peripheral surface of the photosensitive member, which is configured to guide an airflow, the cover wall includes an airflow supplying portion which makes airflow of a predetermined velocity in a direction directed to the downstream side of the rotational direction of the photosensitive member in which the outer peripheral surface of the photosensitive member is configured to move, wherein the airflow supplying portion includes:

a first nozzle configured into a first slit shape with a predetermined length in an axial direction of the photosensitive member, said first nozzle is configured to flow a first airflow of a first predetermined velocity to the downstream side of the rotational direction of the photosensitive member in which the outer peripheral surface of the photosensitive member is configured to move;

a second nozzle configured into a second slit shape with a second predetermined length in the axial direction of the photosensitive member, and positioned on the downstream side of the rotational direction of the photosensitive member more than the first nozzle and said second nozzle configured to blow a second airflow of a second predetermined velocity to the downstream side of the rotational direction of the photosensitive member; and an airflow introduction portion which is configured to guide a component of the airflow from the second nozzle interfering with the airflow from the first nozzle in a predetermined direction in an area along the outer peripheral surface of the photosensitive member between the first nozzle and the second nozzle.

2. The image forming device according to claim 1 wherein an angle between a chief flow of the airflow configured to be supplied from at least one of the first or the second nozzle to the photosensitive member and a tangential line of the outer peripheral surface of the photosensitive member is 30° to 75°.

3. An image forming device comprising:

a photosensitive member, having an outer peripheral surface configured to rotate in a rotational direction, said photosensitive member configured to hold an electrostatic latent image, on the outer peripheral surface;

a developing device configured to supply a liquid developer containing toner particles and a carrier liquid to the electrostatic latent image to form a developer image on the outer peripheral surface of the photosensitive member; and a cover wall, located downstream side of the developing device with respect to the rotational direction of the photosensitive member and extended along the outer peripheral surface of the photosensitive member with a gap relative to the outer peripheral surface of the photosensitive member, which is configured to guide an airflow, the cover wall includes an airflow supplying portion which makes airflow of a predetermined velocity in a direction directed to the downstream side of the rotational direction of the photosensitive member in which the outer peripheral surface of the photosensitive member is configured to move, wherein the airflow supplying portion includes:

a first nozzle configured into a first slit shape with a predetermined length in an axial direction of the photosensitive member, said first nozzle is configured to blow a first airflow of a first velocity to the downstream side of the rotational direction of the photosensitive member in which the outer peripheral surface of photosensitive member holder is configured to move;

a second nozzle which is formed into a second slit shape with a second predetermined length in the axial direction of the photosensitive member, and positioned on the downstream side of the rotational direction of the photosensitive member more than the first nozzle and said second nozzle is configured to blow second airflow of a second velocity, higher than the first velocity, to the downstream side of the rotational direction of the photosensitive member; and an airflow introduction portion which guides a component of the second airflow interfering with the first airflow in a predetermined direction in an area along the outer peripheral surface of the photosensitive member between the first nozzle and the second nozzle.

4. The image forming device according to claim 3, wherein the second velocity is larger by approximately 5 times the first velocity.

5. A method of forming an image, comprising:

forming an electrostatic latent image in a photosensitive member to produce a formed electrostatic latent image;

supplying a liquid developer in which toner is dispersed in a carrier liquid to the formed electrostatic latent image to form a toner image on the photosensitive member;

setting a carrier liquid left in the toner image formed on the photosensitive member to a state of being easily evaporated with supplying airflows of predetermined velocities; and drying the carrier liquid left in the toner image on the photosensitive member and set to the state of being easily evaporated with supplying airflows having higher velocities than the predetermined velocities.

6. The method according to claim 5, wherein the airflows of the predetermined velocities used in the setting the carrier liquid to the state of being easily evaporated and in the drying the carrier liquid are accompanied by generating airflows to suppress mutual interference.

7. The method according to claim 6, wherein the airflows to suppress mutual interference are introduced in directions different from flowing directions of the airflows of the predetermined velocities.

8. An image forming device comprising:

a photosensitive member configured to hold an electrostatic latent image;

means for developing the electrostatic latent image to supply a liquid developer containing toner particles and carrier liquid to the electrostatic latent image on the photosensitive member to produce a developed image;

means for transferring the developed image developing by the developing means on the photosensitive member;

means for supplying airflow of a predetermined velocity in a direction directed to a downstream side of a rotational direction of the photosensitive member in which an outer peripheral surface of the photosensitive member is rotated, the supplying means includes at least two nozzles, and is disposed along the photosensitive member in an area along the outer peripheral surface of the photosensitive member between the developing means and the transferring means, wherein the supplying means includes:

a first means, formed into a first slit shape, for generating first airflow of a first predetermined velocity to the downstream side of the rotational direction of the photosensitive member along the outer peripheral surface;

a second means, formed into a second slit shape and positioned on the downstream side of the rotational direction of the photosensitive member more downstream than the first generating means, for generating second airflow of a second predetermined velocity to the downstream side of the rotational direction of the photosensitive member; and means for guiding a component of the airflow from the second means interfering with the airflow from the first means in a predetermined direction in an area along the outer peripheral surface of the photosensitive member between the first means and the second means.

9. An image forming device comprising:

a photosensitive member configured to hold an electrostatic latent image;

means for developing the electrostatic latent image to supply a liquid developer containing toner particles and carrier liquid to the electrostatic latent image on the photosensitive member to produce a developed image;

means for transferring the developed image developing by the developing means on the photosensitive member;

means for supplying airflow of a predetermined velocity in a direction directed to a downstream side of a rotational direction of the photosensitive member in which an outer peripheral surface of the photosensitive member is rotated, the supplying means includes at least two nozzles, and is disposed along the photosensitive member in an area along the outer peripheral surface of the photosensitive member between the developing means and the transferring means, wherein the supplying means includes:

a first means formed into a first slit shape for generating first airflow of a first velocity to the downstream side of the rotational direction of the photosensitive member along the outer peripheral surface;

a second means formed into a second slit shape and positioned on the downstream side of the rotational direction of the photosensitive member more downstream than the first generating means, for generating second airflow of a second velocity, higher than the first velocity, to the downstream side of the rotational direction of the photosensitive member; and means for guiding a component of the airflow from the second means interfering with the airflow from the first means in a predetermined direction in an area along the outer peripheral surface of the photosensitive member between the first means and the second means.

* * * * *